United States Patent [19]

Kimura et al.

[11] 4,100,041

[45] Jul. 11, 1978

[54] METHOD OF FORMING A COLORED AND OXIDE FILM ON ALUMINUM AND ALUMINUM ALLOYS

[75] Inventors: Shozo Kimura, Osaka; Hidetoshi Yoshida, Oizumi, both of Japan

[73] Assignee: Toyo Chuo Kagaku Kenkyusho, Oizumi, Japan

[21] Appl. No.: 837,878

[22] Filed: Sep. 29, 1977

Related U.S. Application Data

[63] Continuation-in-part of Ser. No. 780,494, Mar. 23, 1977, abandoned.

[30] Foreign Application Priority Data

Apr. 14, 1976 [JP] Japan ..... 51-41247

[51] Int. Cl.[2] ..... C25D 11/08; C25D 11/10

[52] U.S. Cl. ..... 204/58

[58] Field of Search ..... 204/58

[56] References Cited

FOREIGN PATENT DOCUMENTS 1,913,574 10/1970 Fed. Rep. of Germany ..... 204/58

*Primary Examiner*—R. L. Andrews

*Attorney, Agent, or Firm*—Stevens, Davis, Miller & Mosher

[57] ABSTRACT

A method in which aluminum and aluminum alloys are subjected to anodic oxidizing treatment by use of a novel electrolyte to form a good colored and oxide film on the surface thereof. The electrolyte comprises an organic acid solution resulting from the sulfonation of fumaric acid (hereinafter tentatively referred to as the sulfofumaric acid) as a main liquid, into which either oxalic acid as an organic acid, or sulfuric acid or metal sulfate as the inorganic acid are added.

1 Claim, No Drawings

METHOD OF FORMING A COLORED AND OXIDE FILM ON ALUMINUM AND ALUMINUM ALLOYS

This is a continuation-in-part of application Ser. No. 780,494, filed Mar. 23, 1977 now abandoned.

BACKGROUND OF THE INVENTION

This invention relates to a method in which aluminum and aluminum alloys are subjected to anodic oxidizing treatment by use of a novel electrolyte to form a good colored oxide film on the surface thereof.

What is called a natural coloring method, in which aluminum is used as an anode for anodic oxidizing treatment to allow the aluminum to be colored, has generally been known in the prior art. Such known methods include Kalcolor of KAISER, U.S.A., in which the electrolyte's main liquid consists of sulfosalicylic acid and sulfuric acid; Duranodic 300 of ALCORE, U.S.A., in which the electrolyte's main liquid consists of sulfophthalic acid and sulfuric acid; Pechiney's method, Switzerland, in which the electrolyte's main liquid consists of sulfomaleic acid and sulfuric acid. The method in which the electrolyte's main liquid consists of an organic acid, results from the substitution of hydrogen which is not a portion of the acid in succinic acid by a sulfonic radical, and sulfuric acid. In the above-mentioned Kalcolor and Duranodic 300 methods, however, the electrolyte is colored due to electrolysis, oxidization or the like, and B.O.D. (Biochemical Oxygen Demand) and C.O.D. (Chemical Oxygen Demand), which are public hazards of the electrolyte, are extremely high in value, (B.O.D.: 45,000 to 50,000 p.p.m.). As a result, to remove such hazards a large expense is required for waste water equipment, which also results in a higher cost for processing.

Further, in the Kalcolor and Duranodic 300 methods and the method using sulfomaleic acid, a longer electrolytic time for coloring is required, the energized quantity is more than 1.5 A/dm$^2$, and increased electric power is consumed. Moreover, these methods are poor in "color taking", that is, the function of applying uniform color to the entire surface of the treatment members. For example, it is impossible to treat two rows extending between the cathodes. As a result of various experiments, it was found that tasks noted above with respect to the prior art may be solved by using an electrolyte whose main liquid is sulfofumaric acid resulting from the sulfonation of fumaric acid, to which a small amount of inorganic acid or organic acid is added.

SUMMARY OF THE INVENTION

This invention provides a method of forming a color oxide film on aluminum and aluminum alloys wherein defatted and washed aluminum and aluminum alloys are subjected to the treatment of an electrolytic oxidation by a direct current or ac-dc combined current or pulse waveform to an electrolyte prepared by adding, 0.1 – 30 g/l of sulfuric acid as an inorganic acid or 0.1 – 50 g/l of oxalic acid as an organic acid or 0.1 – 50 g/l of a metal sulfate to 5 – 500 g/l of sulfofumaric acid, thereby forming a yellow-black colored oxide film on the aluminum and aluminum alloys.

This invention has the following advantages:

a. The B.O.D. value (500 – 1000 p.p.m.) and C.O.D. value are very low as compared with the prior art methods.

b. The electrolytic time required for coloring is materially reduced as compared with the prior art methods, and the energized quantity is also minimized.

c. Good "color-taking" is obtained, that is, uniform coloring applied to the entire surface of treating members may be accomplished rapidly.

Particularly, in the method of the present invention, the electrolytic time is shortened as illustrated in embodiments described later, and therefore, electric power consumption is reduced, which leads to an advantage in materially reducing cost as compared with the prior art methods. Furthermore, in accordance with the present invention, "color-taking" may effectively be achieved, thus enabling two rows of treating members between the cathodes, while in the prior art, the provision of only one row of such member was possible.

DESCRIPTION OF THE PREFERRED EMBODIMENTS

In accordance with the present invention, aluminum and aluminum alloys are subjected to treatment of anodic oxidation by use of an electrolyte, which comprises a solution of sulfofumaric acid as a main liquid, to thereby form a colored and oxide film on the surface thereof. Further, added to the electrolyte are either sulfuric acid as the inorganic acid, oxalic acid as the organic acid or a metal sulfate.

A description will now be given of one method for the sulfonation of fumaric acid to form an organic acid.

As a raw material, an aqueous solution of fumaric acid is used, into which caustic soda and sodium bisulfite are mixed. The amount added of caustic soda is 2 moles to 1 mole of fumaric acid, and the amount of sodium bisulfite added is 1 mole to 1 mole of fumaric acid. The thus obtained mixed liquid is reacted at a temperature of 80° C for 5 to 6 hours, as a consequence of which a solution of sulfofumaric acid soda is formed having 96 – 98% yield. This solution of sulfofumaric acid soda is then cooled, after which it is diluted to a density of 10 – 50% and subjected to treatment by an acidic ion exchange resin having preregenerated strong or weak acidic cation adsorbing power. As a consequence, a solution of sulfofumaric acid of density 10 – 50% was obtained.

The sulfofumaric acid has, in case of 90% solution, properties as follows:

| | |
|---|---|
| Molecular weight | 198 (estimated) |
| Specific gravity (20° C) | More or less 1.56 |
| State | Colorless, transparent liquid |
| Boiling point | More or less 110° C |
| Melting point | More or less −15° C |
| Viscosity (20° C) | Approx. 100 CPS |
| Solubility (to water at 20° C) | Easy |
| Soluble state: | |
| Ether | Unsoluble |
| Alcohol | Easy |

The structural formula of the sulfofumaric acid having the above-mentioned properties is presumed to be as follows:

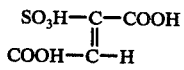

Although the method using an electrolyte whose main liquid is sulfomaleic acid is well known as described above, the present invention uses fumaric acid as the raw material, which is the isomer of maleic acid.

However, the maleic acid is different in properties from the fumaric acid, and also, the sulfomaleic acid is different in properties from the sulfofumaric acid, which is the organic acid resulting from the sulfonation of the first mentioned acid. In case of using the organic acid resulting from the sulfonation of fumaric acid used in the present invention, it has been found that as previously mentioned, time required for coloring may be shortened materially and "color taking" also may be increased materially.

Specifically, the present invention is embodied on the basis of the following requirements:

| | |
|---|---|
| Sulfofumaric acid and | 5 - 500 g/l |
| Additive component such as sulfuric acid, inorganic acid density | 0.1 - 30 g/l |
| or | |
| Additive component such as manganese sulfate, inorganic metallic salt density | 0.1 - 50 g/l |
| or | |
| Additive component such as oxalic acid, organic acid density | 0.1 - 50 g/l |
| Current density: | |
| In case of direct current | 0.3 - 3.0 A/Dm$^2$ |
| In case of DC-AC combined current | D.C.: 0.3 - 3.0 A/Dm$^2$<br>A.C.: 1 - 2.0 A/Dm$^2$ |
| Electrolytic voltage | 40 - 100 V |
| Electrolytic time | 2 - 60 minutes |
| Electrolytic liquid temperature | 0 - 40° C |

For example, a test-piece is colored to a light yellow-brown from a current density of 1.2A/dm$^2$ for 2 minutes of electrolytic time and turned into a yellow-brown color in the same medium after 5 minutes, and after 25 minutes, a color close to black.

As compared with the prior art methods, the electrolytic efficiency of the invention is very good and "color-taking property" is pre-eminent. As a result, volume is greater than in the prior art and production cost is decreased.

In the following examples aluminum alloys 6063-T5 are used as the test-pieces. However, other aluminum alloys (for example, such as 1100-P, 5052-P, etc.) may also be used under similar conditions. In this case, color tone and color feeling may vary slightly with the material used.

| JIS 6063-T5 consists of: | |
|---|---|
| | Weight % |
| Cu | Less than 0.1 |
| Si | 0.20 - 0.6 |
| Fe | Less than 0.35 |
| Mn | Less than 0.1 |
| Mg | 0.45 - 0.90 |
| Zn | Less than 0.1 |
| Cr | Less than 0.1 |
| Ti | Less than 0.1 |

EXAMPLE 1

| Electrolyte composition | |
|---|---|
| Sulfofumaric acid | 70 g/l |
| Sulfuric acid | 0.7 g/l |
| Current density | D.C. 1 A/dm$^2$ |
| Final voltage | 70 V |
| Electrolytic time | 15 minutes |
| Electrolytic liquid temperature | 20 ± 1° C |

As a result of the electrolysis made under the above-mentioned conditions, a beautiful yellow-brown color tone was obtained.

EXAMPLE 2

| Electrolyte composition | |
|---|---|
| Sulfofumaric acid | 50 g/l |
| Sulfuric acid | 0.5 g/l |
| Current density | D.C. 1 A/dm$^2$<br>A.C. 0.5 A/dm$^2$ |
| Voltage | D.C. 70 V<br>A.C. 50 V |
| Electrolytic time | 20 minutes |
| Electrolytic liquid temperature | 20 ± 1° C |

Before anodic oxidation under the above-mentioned conditions, the test-piece was cleaned in a conventional manner. The color produced was a dark yellow different from that of EXAMPLE 1. However, if the portion of alternating current is increased, the surface of the aluminum tends to produce brown spots. For this reason, it is preferable that the current density of the alternating current not be increased to a level more than 1.5 A/dm$^2$. It should be noted that when the portion of the direct current is increased by varying the rate of power supply, a yellow tint disappears, and a brown film deeply tinged with black is obtained.

EXAMPLE 3

| Electrolyte composition | |
|---|---|
| Sulfofumaric acid | 100 g/l |
| Oxalic acid | 15 g/l |
| Current density | D.C. 1 A/dm$^2$ |
| Voltage | 75 V |
| Electrolytic time | 10 minutes |
| Electrolytic liquid temperature | 20 ± 1° C |

Before anodic oxidation under the above-mentioned conditions, the test-piece was cleaned in a conventional manner. A uniformly beautifully colored film of brown tinged with blue was obtained.

EXAMPLE 4

| | |
|---|---|
| Sulfofumaric acid | 70 g/l |
| Sulfuric acid | 0.7 g/l |
| Curent density | D.C. 1.0 A/dm$^2$ |
| Electrolytic time | 15 minutes |
| Liquid temperature | 10° C - 30° C |

| Liquid Temperature (° C) | Final Voltage (V) | Color Tone |
|---|---|---|
| 10 | 82 | Dark amber |
| 15 | 75 | Somewhat dark amber |
| 20 | 69 | Amber |
| 25 | 64 | Amber |
| 30 | 60 | Light Amber |

EXAMPLE 5

| | |
|---|---|
| SuLfofumaric acid | 30 - 100 g/l |
| Sulfuric acid | 1.0 g/l |
| Current density | D.C. 1.0 A/dm$^2$ |
| Electrolytic time | 15 minutes |
| Electrolyte temperature | 15° C |

| Density of Organic Acid (g/l) | Final Voltage (V) | Color Tone |
|---|---|---|
| 30 | 80 | Dark Amber |
| 50 | 75 | Somewhat dark amber |
| 70 | 72 | Amber |

-continued

| | | |
|---|---|---|
| 100 | 68 | Light amber |

In this Example, the density of sulfuric acid is 1.0 g/l but if the density of organic acid is changed, it is necessary to change the density of sulfuric acid, too.

EXAMPLE 6

| | |
|---|---|
| Sulfofumaric acid | 70 g/l |
| Sulfuric acid | 0.5 g/l - 2.0 g/l |
| Current density | D.C. 1.0 A/dm$^2$ |
| Electrolytic time | 15 minutes |
| Liquid temperature | 15° C |

| Density of Sulfuric Acid (g/l) | Final Voltage (V) | Color Tone |
|---|---|---|
| 0.5 | 82 | Dark amber |
| 1.0 | 72 | Amber |
| 1.5 | 55 | Light amber |
| 2.0 | 50 | Stainless color |

EXAMPLE 7

| | |
|---|---|
| Sulfofumaric acid | 50 g/l |
| Sulfuric acid | 0.6 g/l |
| Current density | D.C. 1.0 A/dm$^2$ |
| Electrolytic time | 5- 20 minutes |
| Electrolyte temperature | 15° C |

| Electrolytic Time (minute) | Final Voltage (V) | Actually Measured Film Thickness (micron meter) | Color Tone |
|---|---|---|---|
| 5 | 62 | 1.5 | Light amber |
| 10 | 70 | 2.7 | Amber |
| 15 | 80 | 4.2 | Dark amber |
| 20 | 90 | 5.8 | Dark amber |

The actually measured film thickness is measured by Permascope.

EXAMPLE 8

| | |
|---|---|
| Sulfofumaric acid | 70 g/l |
| Sulfuric acid | 0.8 g/l |
| Current density | D.C. 0.8 A/dm$^2$ - 1.5 A/dm$^2$) |
| Electrolytic time | 15 minutes |
| Electrolyte temperature | 15° C |

| Current Density (A/dm$^2$ | Final Voltage (V) | Actually Measured Film Thickness (micron meter) | Color Tone |
|---|---|---|---|
| 0.8 | 65 | 3.4 | Amber |
| 1.0 | 75 | 4.2 | Amber |
| 1.2 | 80 | 5.5 | Dark amber |
| 1.5 | 98 | 6.1 | Dark amber |

While constant current electrolysis has been employed in the Examples described above, it will be understood that the operation may be made under other conditions such as a constant voltage system or a system in combination of both the processes.

It further will be noted in Examples 1 to 4 that the density of sulfofumaric acid may be changed to thereby obtain dark and light color tones similar to Example 5 or a slight difference in color feeling.

It also has been found that there is a slight change in dark and light color tone within the allowable range depending upon the level of bath temperature.

What is claimed is:

1. A method of forming a yellow-black colored and oxide film on aluminum and aluminum alloys comprising subjecting defatted and washed aluminum and aluminum alloys to treatment of electrolytic oxidation by direct current, ac-dc combined current or pulse waveform in an electrolyte comprising 5 - 500 g/l of sulfofumaric acid and at least one of 0.1 - 30 g/l of sulfuric acid, 0.1 - 50 g/l of oxalic acid and 0.1 - 50 g/l of metal sulfate.

* * * * *